US008393937B2

(12) United States Patent
Goldberg et al.

(10) Patent No.: US 8,393,937 B2
(45) Date of Patent: Mar. 12, 2013

(54) FLOOR FINISHING MACHINE

(75) Inventors: Jay Michael Goldberg, Englewood, NJ (US); Steven Remer, Newburgh, NY (US); Floyd Johnson, New Windsor, NY (US)

(73) Assignee: Onfloor Technologies, L.L.C., Newburgh, NY (US)

( * ) Notice: Subject to any disclaimer, the term of this patent is extended or adjusted under 35 U.S.C. 154(b) by 411 days.

(21) Appl. No.: 12/669,702

(22) PCT Filed: Jul. 20, 2007

(86) PCT No.: PCT/US2007/016426

§ 371 (c)(1), (2), (4) Date: Jan. 19, 2010

(87) PCT Pub. No.: WO2009/014511

PCT Pub. Date: Jan. 29, 2009

(65) Prior Publication Data

US 2010/0197210 A1 Aug. 5, 2010

(51) Int. Cl.
*B24B 27/08* (2006.01)

(52) U.S. Cl. ..... 451/353; 451/350

(58) Field of Classification Search ..... 451/350, 451/352–354

See application file for complete search history.

(56) References Cited

U.S. PATENT DOCUMENTS

| | | | | |
|---|---|---|---|---|
| 943,727 | A | | 12/1909 | Albers et al. |
| 1,601,087 | A | | 9/1926 | Simpson |
| 1,919,389 | A | | 7/1933 | Myers |
| 1,928,390 | A | | 9/1933 | Myers |
| 1,988,193 | A | | 1/1935 | Edstrom |
| 2,007,073 | A | | 7/1935 | Clarke |
| 2,171,060 | A | | 8/1939 | De Spirt |
| 2,298,054 | A | | 10/1942 | Howell |
| 2,300,138 | A | | 10/1942 | Steele |
| 3,013,287 | A | | 12/1961 | Descarries |
| 3,098,329 | A | | 7/1963 | Doran |
| 3,128,581 | A | | 4/1964 | Tosetti |
| 3,129,539 | A | | 4/1964 | Tempero |
| 3,146,559 | A | | 9/1964 | Wilkinson |
| 3,169,262 | A | | 2/1965 | Allen et al. |
| 3,190,672 | A | | 6/1965 | Swanson et al. |
| 3,354,488 | A | | 11/1967 | Bilde |
| 3,701,221 | A | | 10/1972 | Vinella |
| 3,721,048 | A | | 3/1973 | Rand |
| 4,010,507 | A | | 3/1977 | Johnson |
| 4,097,950 | A | | 7/1978 | Satterfield |
| 4,136,491 | A | | 1/1979 | Redifer |
| 4,150,456 | A | | 4/1979 | Alvarez et al. |
| 4,155,596 | A | | 5/1979 | Brejcha |
| 4,182,001 | A | | 1/1980 | Krause |
| 4,186,967 | A | | 2/1980 | Kuhmonen |
| 4,273,384 | A | | 6/1981 | Freeburn |
| 4,319,434 | A | | 3/1982 | Brejcha |
| 4,335,482 | A | * | 6/1982 | Jones ..... 15/87 |
| 4,490,873 | A | | 1/1985 | Stratton |
| 4,570,388 | A | | 2/1986 | Tano et al. |
| 4,634,188 | A | | 1/1987 | Persson |

(Continued)

*Primary Examiner* — Dung Van Nguyen
(74) *Attorney, Agent, or Firm* — Reising Ethington P.C.

(57) ABSTRACT

A floor finishing machine includes a base frame, a movable frame movably mounted to the base frame, and a plurality of floor finishing units carried by the movable frame, and being pivotable about a generally longitudinal pivot axis and a generally transverse pivot axis. The machine may also include a jack operatively coupled between the base frame and the movable frame, and a vacuum tank carried on the movable frame and straddling the jack.

12 Claims, 7 Drawing Sheets

U.S. PATENT DOCUMENTS 4,654,918 A 4/1987 Cooper
4,709,510 A 12/1987 Giovanni et al.
4,719,659 A 1/1988 Urakami
4,731,956 A * 3/1988 Wood ..... 451/353
4,862,548 A 9/1989 Sergio
4,862,766 A 9/1989 Molders
5,054,245 A 10/1991 Coty
5,080,525 A 1/1992 Bricher et al.
5,170,595 A 12/1992 Wiand
5,209,961 A 5/1993 Yokoi
5,224,301 A 7/1993 Tasikas
5,314,386 A 5/1994 Eide et al.
RE34,822 E 1/1995 Mattson
5,377,375 A 1/1995 Holman et al.
5,416,943 A 5/1995 Weltikol et al.
5,439,413 A 8/1995 Lagler
5,454,751 A 10/1995 Wiand
5,507,061 A 4/1996 Miyazaki
5,524,320 A 6/1996 Zachhuber
5,575,710 A 11/1996 Kramer
5,632,625 A 5/1997 Faust
5,637,032 A 6/1997 Thysell et al.
5,643,047 A 7/1997 Beckett et al.
5,683,143 A 11/1997 Peterson et al.
5,765,250 A 6/1998 Lee
5,772,497 A 6/1998 Dummermuth
5,788,561 A 8/1998 Pearlman et al.
5,816,739 A 10/1998 Allen
5,829,095 A 11/1998 Legatt et al.
5,863,241 A 1/1999 Rottschy
5,875,506 A 3/1999 Plazanet
5,905,927 A 5/1999 Inoue et al.
5,980,371 A 11/1999 McConnell
6,148,476 A 11/2000 Legatt et al.
6,202,775 B1 3/2001 Mattson et al.
6,227,957 B1 5/2001 Legatt et al.
6,238,277 B1 5/2001 Duncan et al.
6,261,164 B1 7/2001 Rivard et al.
6,295,682 B1 10/2001 Klucznik
6,315,648 B1 11/2001 Neer
6,331,138 B1 12/2001 Witters et al.
6,353,957 B1 3/2002 Wolfe et al.
6,419,565 B2 7/2002 Mattson et al.
6,425,169 B1 7/2002 Briscoe
6,450,867 B1 9/2002 Legatt
6,475,067 B1 11/2002 Jones et al.
6,485,360 B1 11/2002 Hutchins
6,494,772 B1 12/2002 Barnes et al.
6,523,906 B1 2/2003 Holder
6,530,821 B2 * 3/2003 Legatt et al. ..... 451/8
6,561,813 B2 5/2003 Rutten et al.
6,595,838 B1 7/2003 Palushi et al.
6,616,517 B2 9/2003 Palushi
6,752,707 B1 6/2004 Palushi
6,783,447 B2 8/2004 Van Vliet et al.
6,836,919 B2 1/2005 Shinler
7,022,004 B2 4/2006 Bohler
7,048,620 B1 5/2006 Riley et al.
7,137,876 B2 * 11/2006 Immordino et al. ..... 451/353
7,261,623 B1 * 8/2007 Palushi ..... 451/350
7,313,839 B2 1/2008 Shinler
7,357,700 B2 * 4/2008 Lundberg et al. ..... 451/353
7,568,254 B2 * 8/2009 Duncan et al. ..... 15/49.1
7,828,632 B2 * 11/2010 Palushi ..... 451/350
2005/0164616 A1 7/2005 Thysell
2007/0232207 A1 10/2007 Palushi

* cited by examiner

FLOOR FINISHING MACHINE

CROSS REFERENCE TO RELATED APPLICATION

This application is a national stage application of, and claims the benefit of priority to, International Application PCT/US2007/016426, originally filed Jul. 20, 2007 and published as International Publication WO 2009/014511 A1 on Jan. 29, 2009, the contents of which are hereby incorporated by reference in its entirety.

TECHNICAL FIELD

The field of this invention relates to floor finishing machines.

BACKGROUND OF THE DISCLOSURE

Hardwood floors have long been a desirable trait in a home and are also common in gymnasiums, bowling alleys, and ballrooms. However, sanding and refurbishing a hardwood floor is one of the more difficult do-it-yourself tasks for a homeowner or business owner. And, although concrete or cement is a very popular material for use in floors and construction materials because of its strength, durability and low costs, if the concrete or cement is left unfinished, the concrete floor will inherently produce dust by the constant scuffing it undergoes whether by foot traffic or wheeled traffic and be susceptible to staining due to porosity.

SUMMARY OF THE DISCLOSURE

In accordance with one aspect of the invention, there is provided a floor finishing machine including a base frame, a movable frame movably mounted to the base frame, and a plurality of floor finishing units carried by the movable frame, and being pivotable about a generally longitudinal pivot axis and a generally transverse pivot axis. The machine may also include a jack operatively coupled between the base frame and the movable frame, and a vacuum tank carried on the movable frame and straddling the jack.

BRIEF DESCRIPTION OF THE DRAWINGS

Reference now is made to the accompanying drawings in which.

DETAILED DESCRIPTION OF THE PREFERRED EMBODIMENT

Figure 1:
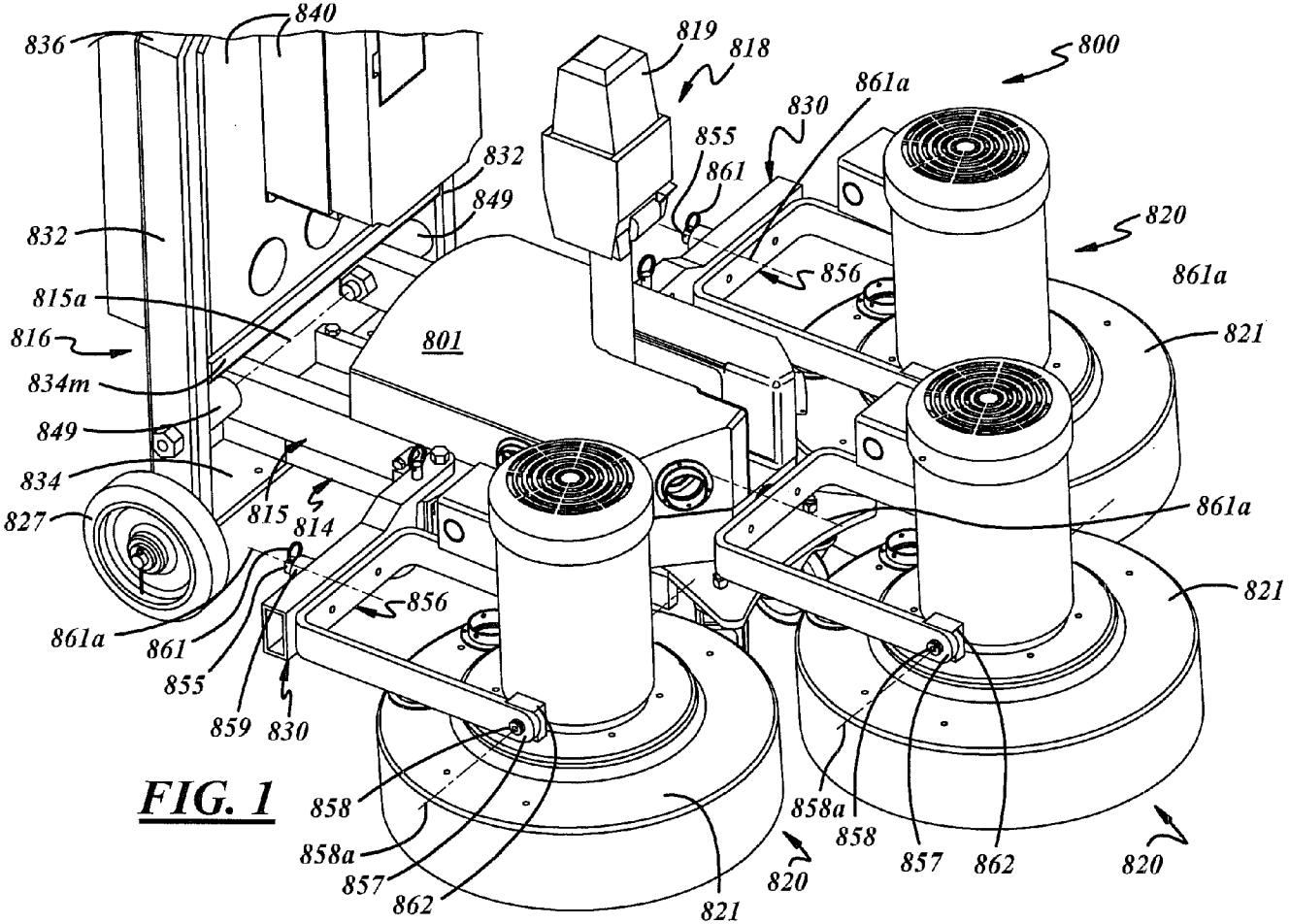
FIG. 1 is a fragmentary perspective view of a floor finishing machine according to an embodiment of the present invention.

Referring now to FIG. 1-11 illustrate presently preferred embodiments of a floor finishing machine 800. This embodiment is similar in many respects to exemplary equipment disclosed in U.S. Pat. No. 7,261,623 B2, which is assigned to the assignee hereof and is incorporated herein by reference in its entirety.

The machine 800 generally may include a base frame 814, a rear frame 816 that may be integrated with or separate from the base frame 814, and a movable frame 815 that may be movably mounted to another portion of the machine 800 so as to be movable with respect to the base frame 814. More particularly, the movable frame 815 may be pivotably mounted to the rear frame 816 so as to be pivotable with respect to the base frame 814. The machine 800 also may include a jack 818 operatively coupled between the base frame 814 and the movable frame 815 as will be described in greater detail below. The machine 800 further may include floor finishing units 820 movably carried by the movable frame 815 and may be arranged in an overlapping delta pattern as shown. The machine 800 additionally may include a vacuum tank 801 carried by the movable frame 815. The frames 814, 815, 816 may be composed of steel, but also or instead may be composed of any material including plastic, composites, or other metals including iron, aluminum, and the like.

Figure 2:
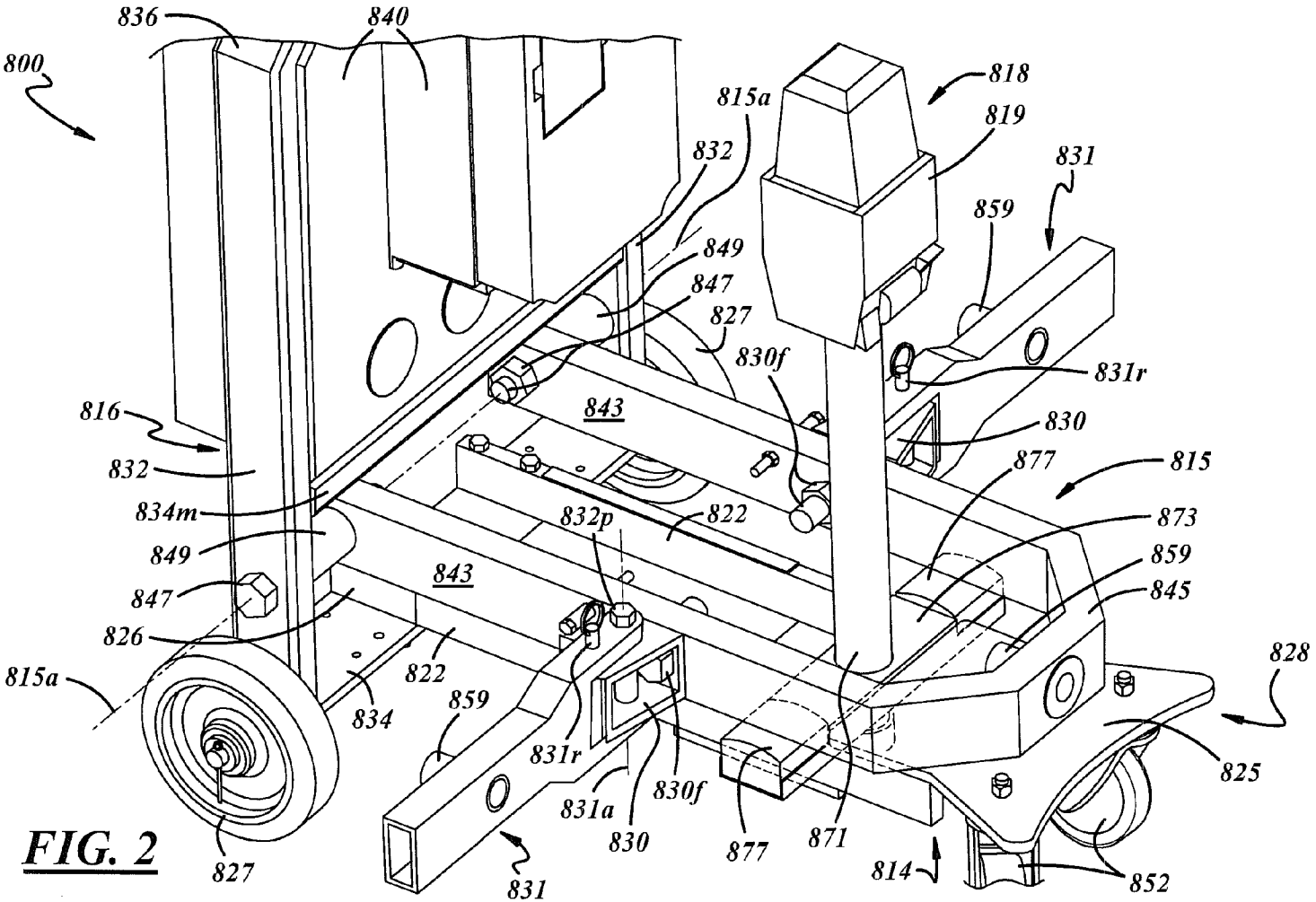
FIG. 2 is a fragmentary perspective view of a frame portion of the floor finishing machine of FIG. 1.
Figure 3:
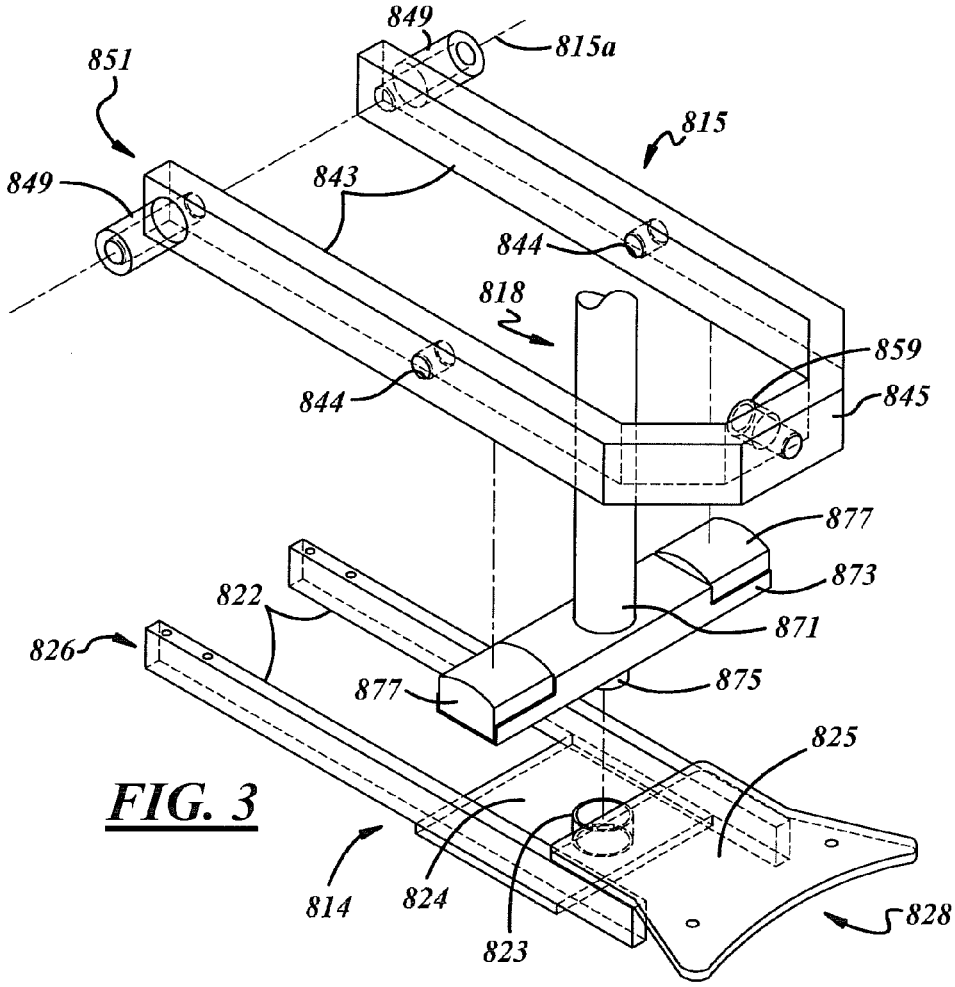
FIG. 3 is an exploded perspective view of a frame portion of the floor finishing machine of FIG. 1.

Referring to FIGS. 2 and 3, the base frame 814 may include struts 822 extending generally longitudinally and one or more crossmembers extending generally transversely therebetween to provide rigidity to the frame 814. As used herein, the term "transverse" includes a direction oriented across some other direction at any angle including but not limited to perpendicular or right angles. The crossmembers may include a rear crossmember 834 (FIG. 2) extending between the struts 822 at a rear end 826, an intermediate crossmember 824 (FIG. 3) extending between the struts 822, and/or a forward crossmember 825 extending between the struts 822 at a front end 828 (FIG. 3). As shown in FIG. 3, a tube 823 may be welded to or otherwise carried by the intermediate crossmember 824 for accepting an inner member 875 of the jack 818. The forward crossmember 825 may include portions to which wheels 852 (FIG. 2), such as casters, may be mounted.

Referring now to FIGS. 1 and 2, the rear frame 816 may be integral with or separate from the rear end 826 (FIG. 3) of the base frame 814. The rear frame 816 includes upwardly and longitudinally extending uprights 832 that are interconnected by crossmembers 834m and 834, which transversely extend therebetween. Wheels 827 may be rotatably mounted to the uprights 832 and/or to the crossmember 834.

Figure 5:
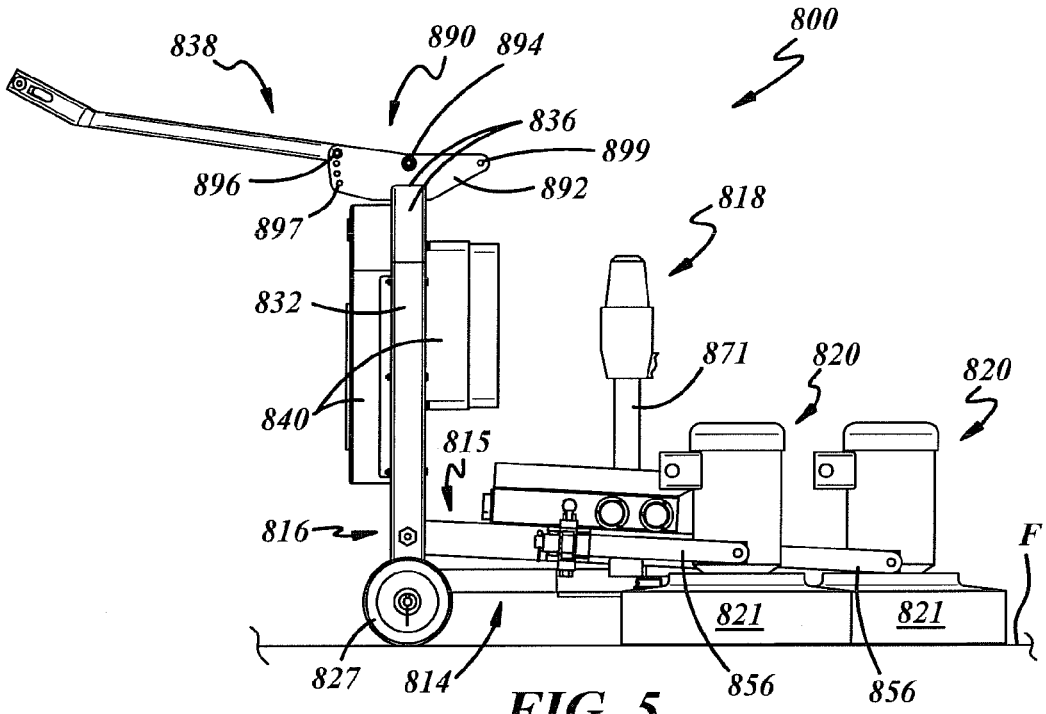
FIG. 5 is a side view of the floor finishing machine of FIG. 1, illustrating the machine in a working position.
Figure 6:
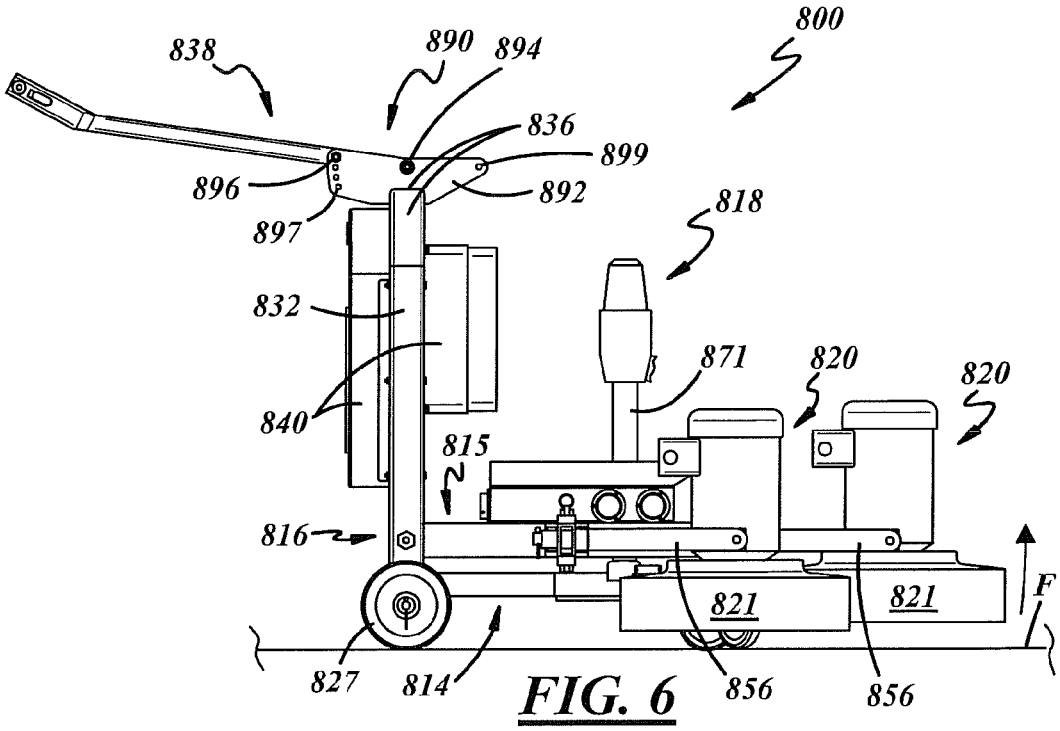
FIG. 6 is a side view of the floor finishing machine of FIG. 1, illustrating the machine in an intermediate position.
Figure 7:
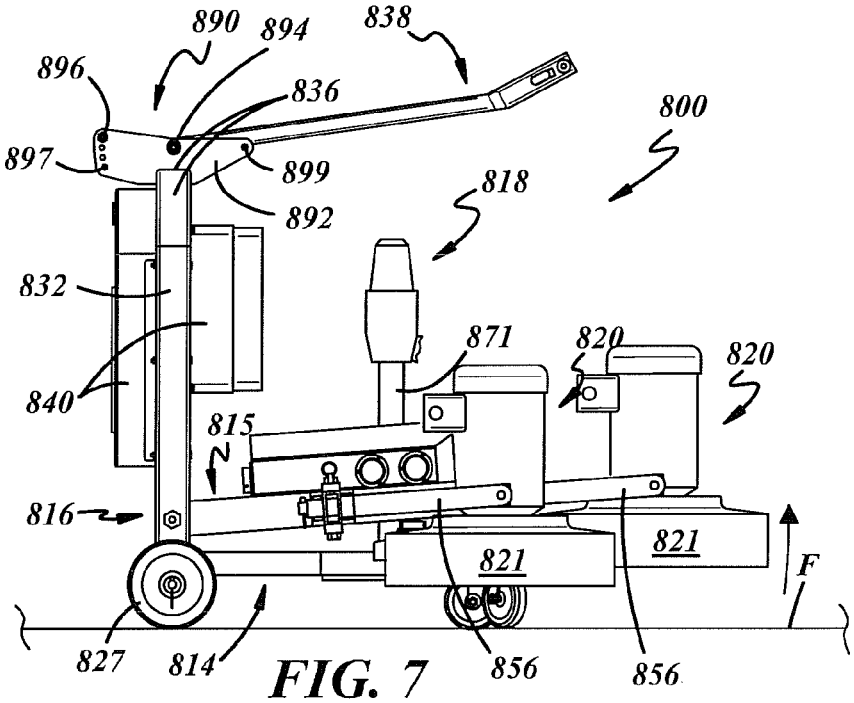
FIG. 7 is a side view of the floor finishing machine of FIG. 1, illustrating the machine in a raised position.
Figure 8:
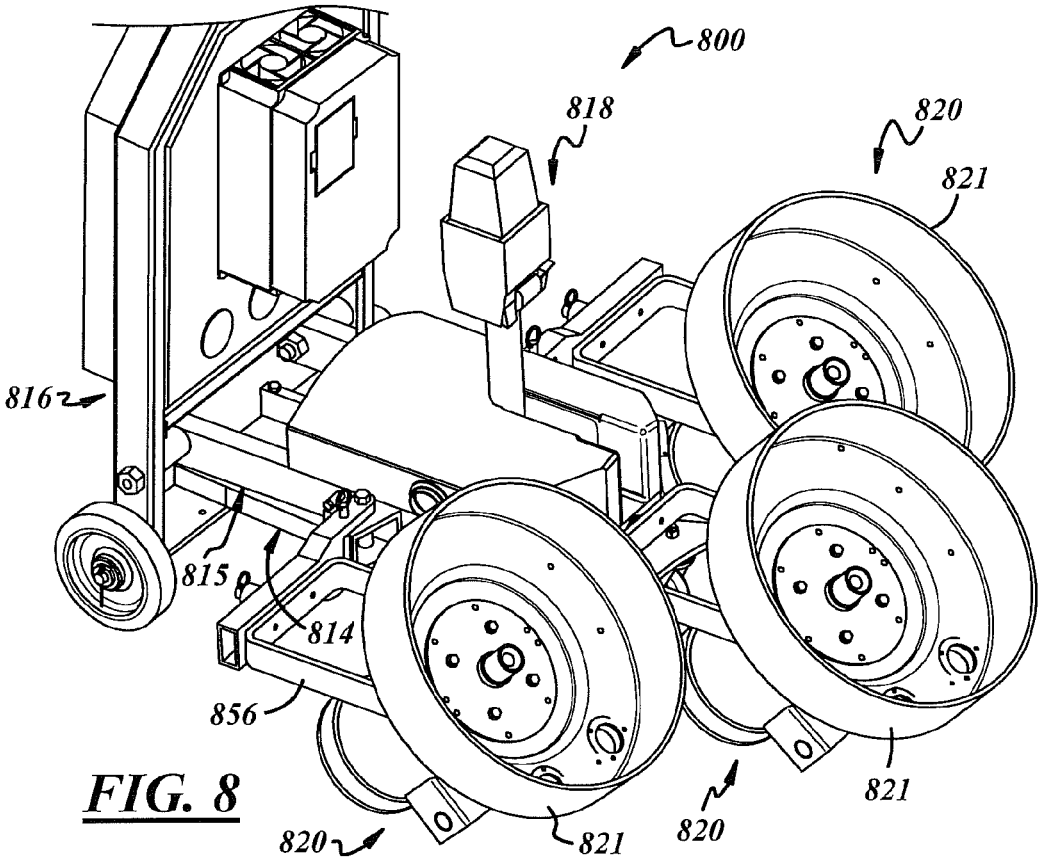
FIG. 8 is a perspective view of the floor finishing machine of FIG. 1, illustrating floor finishing units being pivoted about a transverse axis to a pad change position.

As shown in FIGS. 5-7, the rear frame 816 may include a generally upside-down U-shaped upper portion 836, which may be welded or otherwise joined to upper ends of the uprights 832. An adjustable handle 838 may be welded to or otherwise carried by the upper portion 836, and service panels 840 may be carried between the uprights 832. The service panels 840 may include one or more batteries and electrical controls to operate the floor finishing units 820. A handle adjustment mechanism 890 may include a pair of spaced apart plates 892 (one shown) welded or otherwise joined to the upper portion 836. The handle adjustment mechanism 890 may also include a pivot pin 894 carried through the plates 892 and a fixed end of the handle 828 so as to pivotably mount the handle 828 to the rear frame 816. The plates 892 may include a plurality of adjustment holes 897 through which a handle pin 896 may be removably inserted, wherein the pin 896 may also extend through a portion of the handle 828 to fix the handle 828 in one of several adjustment positions. The plates 892 may also include at least one handle storage hole 899 through which the handle pin 896 may be removably inserted. The pin 896 may also extend through a portion of the handle 828 and in general alignment with the storage hole 899, after the handle 828 is pivoted about the pin 894 to a storage position extending over the jack 818, as shown in FIG. 7.

Referring to FIGS. 2-3, the movable frame 815 may be pivotable about a pivot axis 815*a* with respect to the base frame 814. The pivot axis 815*a* may be transversely oriented with respect to the generally longitudinal axis or direction of travel of the machine 800. The movable frame 815 may include struts 843 extending generally longitudinally, and one or more crossmembers 845 extending generally transversely between the struts 843 to provide rigidity to the frame 815. The movable frame 815 may be pivotably mounted to the rear frame 816 in any suitable manner, for example, by fasteners 847 (FIG. 2) extending through bushings 849 (FIG. 3), which may be welded to or otherwise carried by the struts 843 at a rear end 851 (FIG. 3).

As shown in FIG. 2, beams 831 mount the floor finishing units 820 to the movable frame 815 and may be pivotably mounted to mounts 830 with pivot pins 831*p* or the like about pivot axes 831*a* (one shown) and may extend transversely in an outboard direction away from the struts 843. The mounts 830 may be fastened to or otherwise carried by the struts 822 such as by fasteners 830*f* extending through bushings 844 (FIG. 3) in the struts 822.

Figure 9:
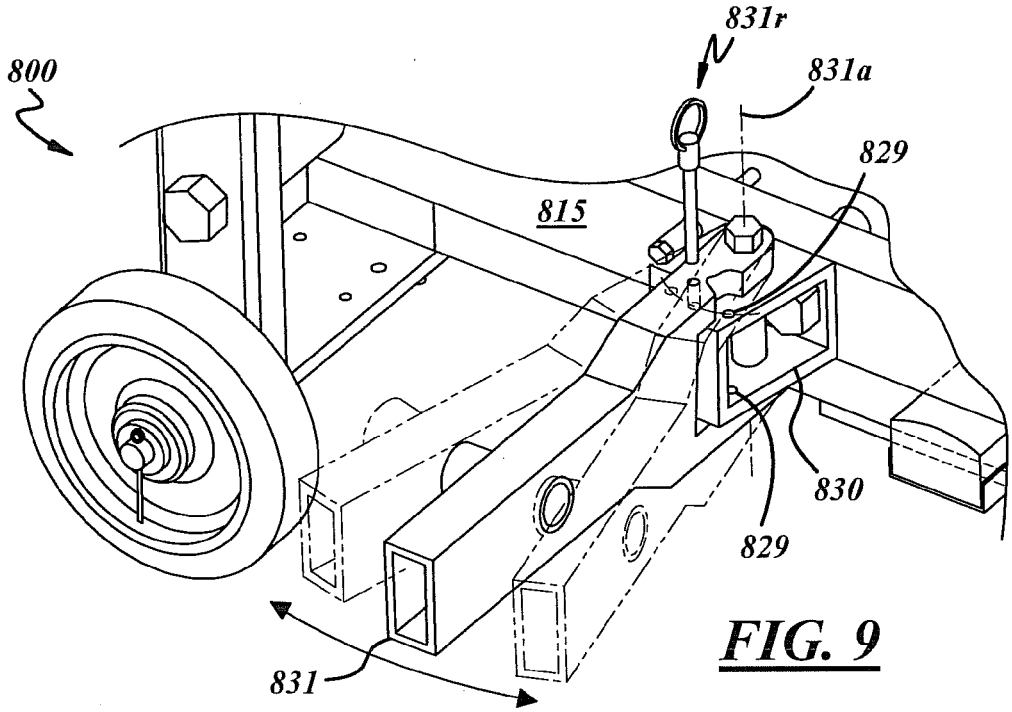
FIG. 9 is a fragmentary perspective view of the floor finishing machine of FIG. 1, illustrating pivotable adjustment of a beam.

As best shown in FIG. 9, the beams 831 may be fixed in one or more positions with respect to the mounts 830 using removable pins 831*r* that may be inserted through the beams 831 and through a plurality of adjustment holes 829 in the mounts 830. Accordingly, the beams 831 may be pivotably adjusted to adjust diametral overlap of the floor finishing units 820 (FIG. 1).

As shown in FIG. 1, the floor finishing units 820 may be positioned outside of the movable frame 815 and may be mounted thereto by the pivotable links 856. For example, one of the floor finishing units 820 may be mounted centrally at a front end of the movable frame 815, and two of the floor finishing units 820 may be mounted on opposite lateral sides of the frame 815. Rear ends 855, such as shafts, of pivotable links 856 may be pivotably mounted to the beams 831 and the crossmember 845 about pivot axes generally defined by bushings 859 welded to or otherwise carried by the frame 815. The links 856 are retained to the beams 830 by retainer pins 861 extending through the rear ends 855 and the bushings 859. Front ends 857 of the pivotable links 856 may pivotably carry the floor finishing units 820. The pivotable links 856 may be in the form of a yoke with the rear end 855 forming the bight section. The floor finishing units 820 may have shrouds 821 with bosses 862 mounted thereon surround its motor section 811 and to which the links 856 are pivotably attached by mounting pins or fasteners 858 extending through holes in the ends 857 of the links 856.

Figure 10:
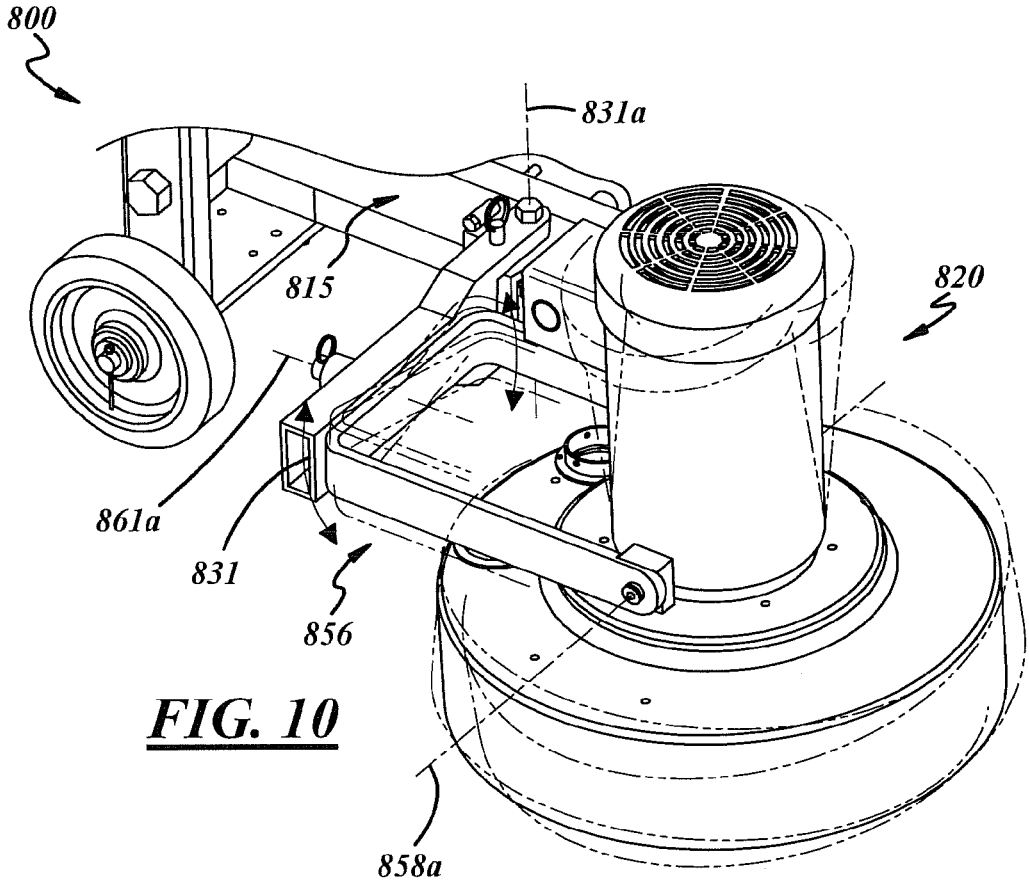
FIG. 10 is a fragmentary perspective view of the floor finishing machine of FIG. 1, illustrating pivotable movement of a floor finishing unit about two axes.

As shown in FIG. 10, this mounting arrangement allows for the links 856 and, therefore, the floor finishing units 820, to be pivotably displaceable about a first or longitudinal axis 861*a* with respect to the movable frame 815. Additionally, the floor finishing units 820 are pivotable with respect to the links 856 and movable frame 815 about a second or transverse axis 858*a* with respect to the movable frame 815. The first and second axes 861*a*, 858*a*, are both generally transversely oriented with respect to the generally vertical pivot axes 831*a* of the beams 831. Accordingly, the floor finishing units 820 have at least two degrees of freedom with respect to the movable frame 815. Such freedom allows the machine 800 to be particularly forgiving and effective in finishing floors that have uneven surfaces.

Referring now to FIGS. 2 and 3, the jack 818 may be an off-the-shelf device, such as any suitable powered jack and may include a motor and control housing 819 (FIG. 2). An outer member 871 of the jack 818 may be welded or otherwise joined to a crossmember 873 that may be interposed between the base frame 814 and the movable frame 815 and that may include wear pads 877. As shown in FIG. 3, the end of an inner member 875 of the jack 818 bears against or engages the intermediate crossmember 824 and may be carried within and joined in any suitable manner to the tube 823 of the intermediate crossmember 824 of the base frame 814. Referring to FIGS. 2 and 3, those skilled in the art will appreciate that as the jack motor (not shown) rotates, the crossmember 873, outer member 871, and housing 819 (FIG. 2) are linearly displaced with respect to the inner member 875 (FIG. 3). Thus, because the crossmember 873 is adapted to carry the movable frame 815, the jack 818 may be activated to linearly displace and raise the movable frame 815 relative to the base frame 814 because the movable frame 815 is pivotable about its pivot axis 815*a*. Accordingly, the powered jack 818 is specially adapted for this floor finisher application for adjusting the height of the movable frame 815 with respect to the base frame 814 and the floor to be finished.

Figure 4:
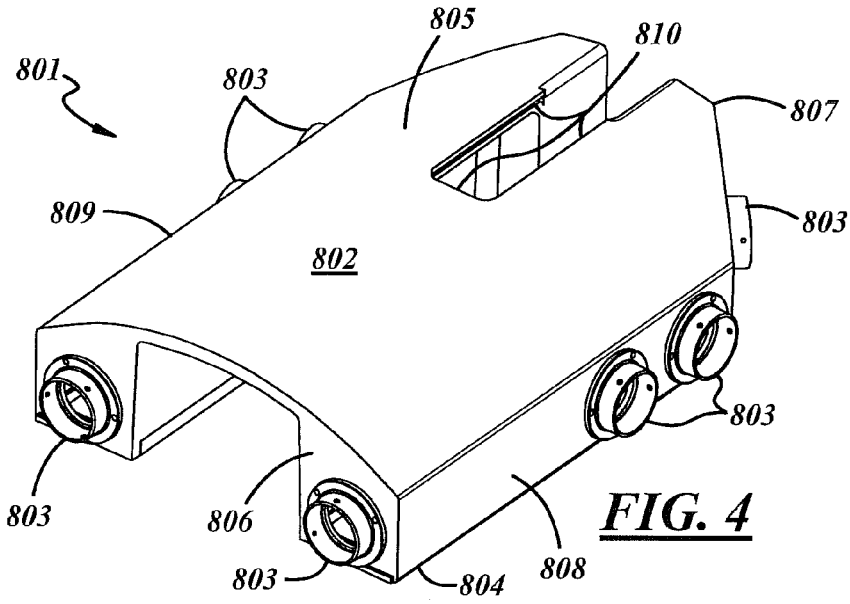
FIG. 4 is an enlarged perspective view of a vacuum tank assembly of the floor finishing machine of FIG. 1.

Referring now to FIG. 4, the vacuum tank assembly 801 includes a generally hollow tank 802, and a plurality of hose fittings 803 in communication with the interior of the tank 802 and being carried by the tank 802. The hose fittings 803 may be fastened, adhered, welded, integrated, or the like to the tank 802. The tank 802 may be manufactured in any suitable manner from any suitable material, such as being injection molded or blow molded from a polymeric material. The tank includes a bottom 804, a top 805, a rear 806, a front 807, and opposed sides 808, 809, with a generally horizontal disposition to keep a low profile above and along the frame 815. As shown, two or more hose fittings 803 may be provided for each of the floor finishing units 820 (FIG. 1) and are disposed about a lateral periphery of the tank 802 such that hose fittings 803 are provided in the rear 806, front 807 (only one shown), and sides 808, 809. The tank 802 includes a notch or relieved portion 810 in open communication with the front 807 to accommodate the jack 818 (FIG. 1). The straddling of the tank 802 about the jack 818 allows the tank 802 to be in a more forward position, maintain its low profile, and have greater capacity.

Referring now to FIGS. 5-7, the machine 800 is shown in three different adjustment positions. In FIG. 5, the machine 800 is in a working position wherein the jack 818 is lowered such that the movable frame 815 is lowered, so as to bring the floor finishing units 820 into contact with the floor F for floor finishing. In FIG. 6, the machine 800 is in an intermediate position wherein the jack 818 is raised somewhat such that the movable frame 815 is generally parallel to the base frame 814 and/or the floor F, so as to lift the floor finishing units 820 away from the floor F. In FIG. 7, the machine 800 is in a raised position wherein the jack 818 is raised such that the movable frame 815 is raised, so as to render it easier to pivot the floor finishing units 820 for access to the bottom of the floor finishing units 820, as better shown in FIG. 8. The jack 818 may be raised even further beyond that shown in FIG. 7. Accordingly, an operator has easy access to the floor finishing units 820 such as to clean or replace finishing pads or otherwise maintain the machine 800.

Figure 11:
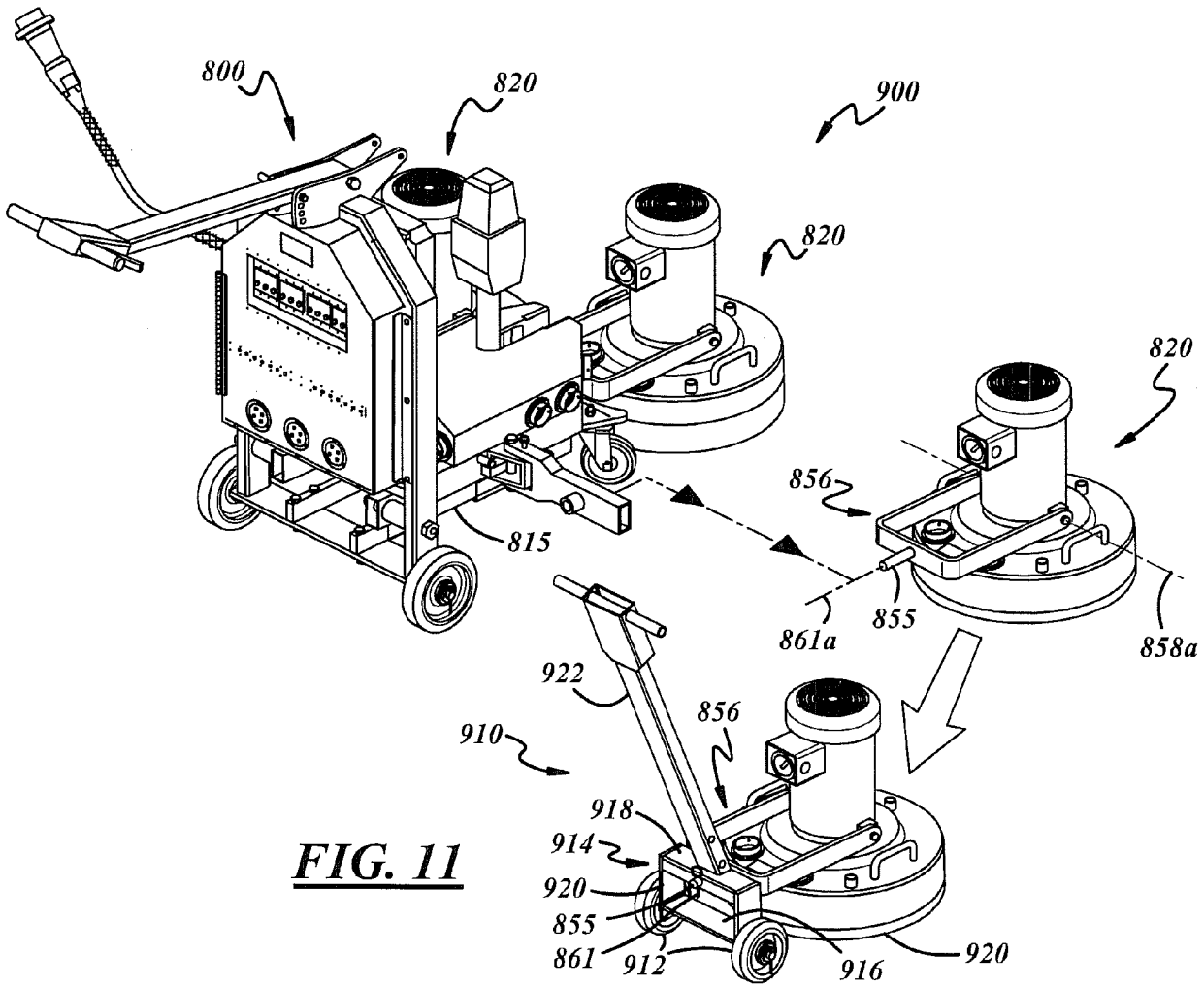
FIG. 11 is a perspective view of a modular floor finishing apparatus including the floor finishing machine of FIG. 1.

Referring now to FIG. 11, the modular aspect of the floor finishing apparatus 900 is illustrated by showing how the floor finishing unit 820 can be easily moved between its mounted position with the floor finishing machine 800 described above and a hand truck 910 to be used as a single unit assembly. The hand truck 910 may include wheels 912, which are carried by a frame 914 that may include crossmembers 916, 918 and uprights 920, and a handle 922 attached in any suitable manner to the frame 914 such as by being welded or otherwise attached to the crossmember 918. The floor finishing units 820 are carryable by the frame 815 of the floor finishing machine 800 so as to be pivotable about their generally longitudinal pivot axes 861*a* and their generally transverse pivot axes 858*a*, and one of the floor finishing units 820 at a time is also separately carryable by the hand truck 910 so as to be pivotable about each respective generally longitudinal pivot axis 861*a* and each respective generally transverse pivot axis 858*a*. The rear end 855 of the pivotable link 856 of the floor finishing unit 820 may be pivotably mounted to the crossmember 918 of the hand truck 910 in any suitable manner, including using one or more bushing, bearings, or the like (not shown). The link 856 is retained to the crossmember 918 by the retainer pin 861 extending through the rear end 855 of the link 856. The floor finishing unit 820 may be electrically and pneumatically powered in any suitable manner such as by a remote power supply and vacuum (not shown). As such, when a smaller unit is needed, the unit 820 may be dismounted from machine 800 and connected to hand truck 910. When hand truck 910 is so longer needed, the unit 820 may be easily moved back to machine 800.

Each of the above-disclosed embodiments includes elements and features that may be interchanged with any and all of the other above-disclosed embodiments to produce a novel and nonobvious floor finishing machine.

Variations and modifications are possible without departing from the scope and spirit of the present invention as defined by the appended claims

The invention claimed is:

1. The floor finishing machine comprising:

a base frame;

a movable frame movably mounted to the base frame;

a plurality of floor finishing units carried by the movable frame, and being pivotable about a generally longitudinal pivot axis and a generally transverse pivot axis;

a jack operatively coupled between the movable frame and the base frame; and wherein the jack includes an outer member, a crossmember fixed to the outer member and disposed between the movable frame and the base frame, and an inner member engaged against the base frame.

2. The floor finishing machine of claim 1, further comprising a rear frame coupled to the base frame and including uprights.

3. The floor finishing machine of claim 2, wherein the movable frame is pivotably mounted to the uprights of the rear frame.

4. The floor finishing machine of claim 1, further comprising wheels carried by the base frame at a front end thereof.

5. The floor finishing machine comprising;

a base frame;

a movable frame movably mounted to the base frame;

a plurality of floor finishing units carried by the movable frame, and being pivotable about a generally longitudinal pivot axis and a generally transverse pivot axis;

a jack operatively coupled between the movable frame and the base frame; and a vacuum tank carried on the movable frame and straddling the jack.

6. The floor finishing machine of comprising:

a base frame;

a movable frame movably mounted to the base frame;

a plurality of floor finishing units carried by the movable frame, and being pivotable about a generally longitudinal pivot axis and a generally transverse pivot axis;

at least one beam mounted to and extending transversely from the movable frame;

at least one pivotable link pivotably mounted to the beam, wherein at least one of the plurality of floor finishing units is pivotably mounted to the pivotable link; and wherein the at least one beam is pivotably mounted to the movable frame, wherein the at least one beam is pivotably adjustable to different affixed positions to change diametral overlap of at least two of the plurality of floor finishing units.

7. The floor finishing machine of comprising:

a pivotable frame;

a plurality of floor finishing units carried by the pivotable frame, and being pivotable about a generally longitudinal pivot axis and a generally transverse pivot axis;

a base frame and a jack operatively coupled between the pivotable frame and the base frame; and wherein the jack includes an outer member, a crossmember fixed to the outer member and disposed between the pivotable frame and the base frame, and an inner member engaged against the base frame.

8. The floor finishing machine comprising:

a pivotable frame;

a plurality of floor finishing units carried by the pivotable frame, and being pivotable about a generally longitudinal pivot axis and a generally transverse pivot axis;

at least one beam mounted to the pivotable frame and at least one pivotable link pivotably mounted to the beam, wherein at least one of the plurality of floor finishing units is pivotably mounted to the pivotable link; and wherein the at least one beam is pivotably mounted to the pivotable frame, extends generally transversely from the pivotable frame, wherein the at least one beam is pivotably adjustable to different affixed positions to change diametral overlap of at least two of the plurality of floor finishing units.

9. A floor finishing machine comprising:

a base frame;

a pivotable frame having one end pivotably mounted to the base frame about one pivot axis to carry a plurality of floor finishing units; and at least one beam pivotably mounted to the pivotable frame, and extending generally transversely from the pivotable frame, and at least one pivotable link pivotably mounted to the at least one beam, wherein at least one of the plurality of floor finishing units is pivotably mounted to the pivotable link; and wherein the at least one beam is pivotably adjustable to different affixed positions to change diametral overlap of at least two of the plurality of floor finishing units.

10. The floor finishing machine of claim 9, further comprising a base frame and a jack operatively coupled between the frame and the base frame to move the frame with respect to the base frame.

11. A modular floor finishing apparatus comprising:

the floor finishing machine having:

a base frame;

a movable frame movably mounted to the base frame; and a plurality of floor finishing units carried by the movable frame, and being pivotable about a generally longitudinal pivot axis and a generally transverse pivot axis; and a hand truck separate from the floor finishing machine, and each floor finishing unit is also removable from said floor finishing machine and separately mountable and carryable by the hand truck to be pivotable about the generally longitudinal pivot axis and the generally transverse pivot axis.

12. A modular floor finishing apparatus, comprising:

a floor finishing machine including a frame;

a hand truck separate from the floor finishing machine; and a plurality of floor finishing units carryable by the frame of the floor finishing machine to be pivotable about a generally longitudinal pivot axis and a generally transverse pivot axis, and each floor finishing unit is also separately carryable by the hand truck to be pivotable about the generally longitudinal pivot axis and the generally transverse pivot axis.

* * * * *